US008231108B2

(12) United States Patent
Realegeno-Amaya

(10) Patent No.: US 8,231,108 B2
(45) Date of Patent: Jul. 31, 2012

(54) FURNITURE LIFTER

(76) Inventor: Julio Realegeno-Amaya, Ottawa (CA)

( * ) Notice: Subject to any disclaimer, the term of this patent is extended or adjusted under 35 U.S.C. 154(b) by 507 days.

(21) Appl. No.: 12/424,078

(22) Filed: Apr. 15, 2009

(65) Prior Publication Data

US 2010/0264384 A1 Oct. 21, 2010

(51) Int. Cl.
*B66F 3/25* (2006.01)

(52) U.S. Cl. ..... 254/134; 254/93 R

(58) Field of Classification Search ..... 254/84, 254/134, 200, 93 R

See application file for complete search history.

(56) References Cited

U.S. PATENT DOCUMENTS 2,314,589 A * 3/1943 Mandi ..... 254/93 H
2,432,076 A * 12/1947 Rothery ..... 92/240
2,637,522 A * 5/1953 Wallace ..... 187/219
2,802,635 A * 8/1957 Engelbart ..... 254/1
2,904,308 A * 9/1959 Vergara ..... 254/8 R
3,168,286 A * 2/1965 Rickert ..... 254/134
4,245,808 A * 1/1981 John ..... 248/352
4,629,391 A * 12/1986 Soyk et al. ..... 414/563
4,715,760 A * 12/1987 Browning ..... 414/10
5,156,375 A * 10/1992 Liegel et al. ..... 254/134
5,358,217 A * 10/1994 Dach ..... 254/2 R
5,387,074 A * 2/1995 Brown ..... 414/589
5,915,672 A * 6/1999 Dickey ..... 254/133 R
6,257,552 B1 * 7/2001 Crow et al. ..... 254/2 B
6,378,843 B1 * 4/2002 Hong ..... 254/2 R
6,581,908 B1 * 6/2003 Francis ..... 254/2 B
6,581,921 B2 * 6/2003 Griggs ..... 269/37

* cited by examiner

*Primary Examiner* — David B Thomas

(74) *Attorney, Agent, or Firm* — Sunstein Kann Murphy & Timbers LLP

(57) ABSTRACT

A lifter of furniture and other loads has a wheel-mounted base comprising a plurality of radially extending beams and a transversely mounted, planar support structure. One of the beams lies within the plane defined by the support structure. The support structure has a bracket extending transversely away from the floor surface and adapted to accept a telescoping support in a sliding fit. The telescoping support lies in the plane of the support structure and is adapted to engage a bottom surface of a furniture load and urge it vertically upward relative to the floor surface. The telescoping support and/or the bracket have at least one transverse bore therewithin to accept a cotter pin therethrough as a locking mechanism. The telescoping support is urged upward by a jack mechanism which may be removable for use with other lifters once the telescoping support is locked into position relative to the bracket. Furniture or other loads may be completely supported on a plurality of such lifters such that the lifters and the load may be moved freely across the floor surface as a unit.

21 Claims, 1 Drawing Sheet

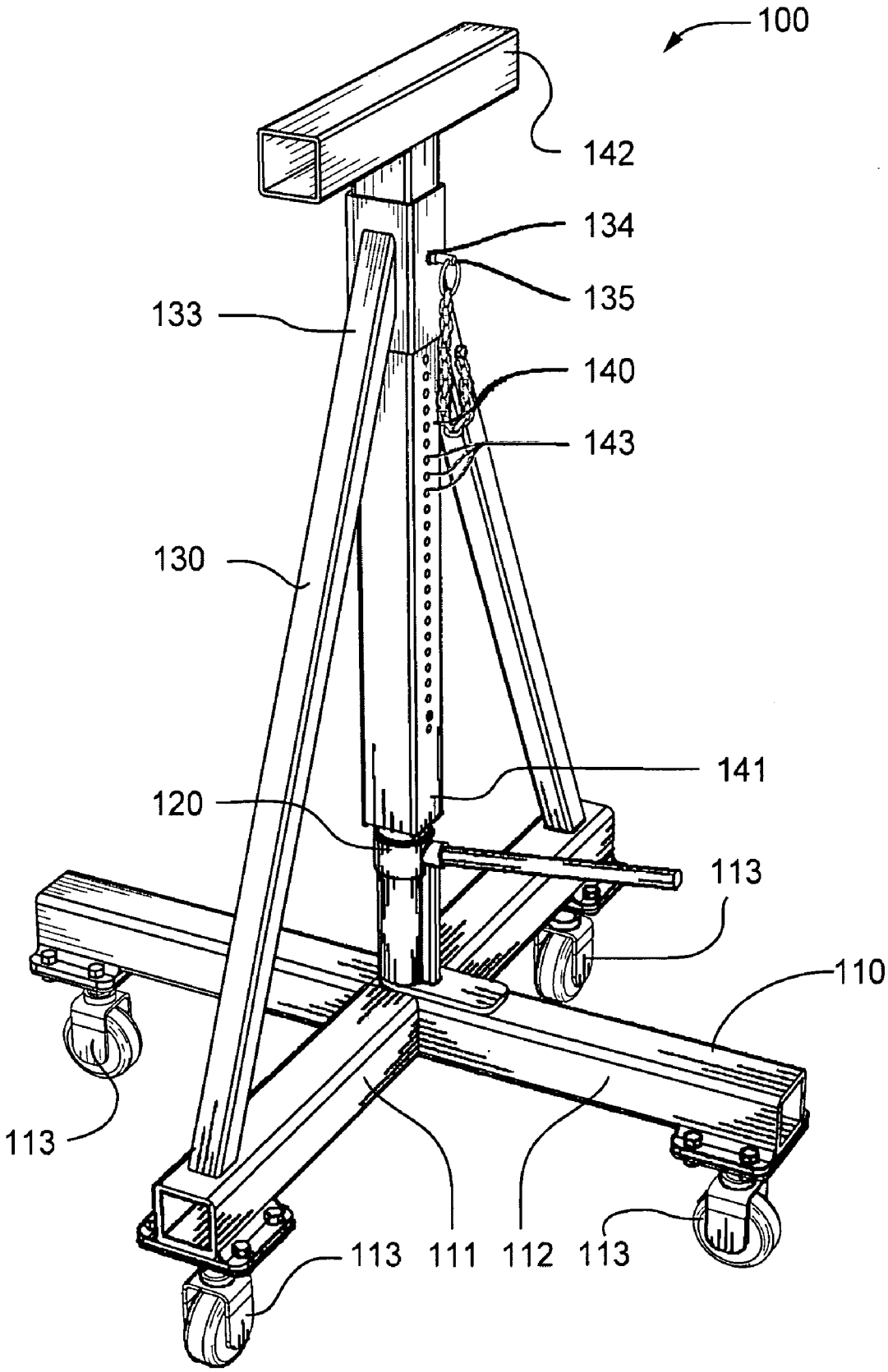
100
142
134
135
133
140
143
130
141
120
113
110
113
113
111
112
113

FURNITURE LIFTER

FIELD OF THE INVENTION

The present invention relates to a lifting apparatus to elevate furniture and other loads, such as those found in office settings, so as to permit access to the underlying carpet or flooring surface.

BACKGROUND

When installing carpet, hardwood floor or other type of floor covering, both the removal of existing floor covering (including preparation of the floor surface) and the installation of the new floor covering is facilitated by having easy access to the floor surface, and in particular, the floor surface near to walls.

Access to the floor surface may not be easily or quickly achieved, particularly in an office setting, because of the presence of furniture and other obstacles positioned across the floor surface.

It may not be convenient to empty the room of the furniture, since there may not be an alternate and convenient space in which the furniture to be removed may be stored. Furthermore, it may be difficult to move the furniture, especially if all of the furniture is being moved, through doorways and openings and there is the possibility of damage to the room walls and doorways and to the furniture itself. Still further, the process of emptying a room of furniture may consume considerable resources, in terms of time, cost and human power.

An alternative that may be suitable in many cases of installation of floor coverings is to temporarily elevate and move the furniture a short distance away from its present location. In many instances, moving the furniture by approximately five feet away from a wall or corner may provide sufficient access to allow the existing floor covering to be removed, the floor surface prepared and the new floor covering to be installed.

There are a number of furniture moving devices. Typically, they consist of a portable structure with an upward extending telescoping portion, typically driven by a hydraulic jack. However, such devices surround the jack portion on all sides by a polygonal support structure for stability, with the result that such devices are typically intended to engage a central portion of the furniture from below and then lift it upward with the assistance of the jack.

For example, U.S. Pat. No. 5,915,672 entitled "Collapsible Jack Stand and Method Therefor" and issued Jun. 29, 1999 to Dickey, discloses a highly portable collapsible jack stand. The jack stand is comprised of a plurality of leg members. Each leg member is detachably coupled to a top guide plate which is used to support and align a telescoping rod. A ram head is coupled to the telescoping rod and is used for supporting a load. A base plate is detachably coupled to the plurality of leg members. The base plate presents the jack stand from sinking into the ground when the jack stand is in use and under a heavy load. A low profile jack may be positioned underneath the telescoping rod for raising and lowering the telescoping rod thus raising and lowering the load on the jack stand apparatus.

Other such devices are designed for specific purposes and load characteristics, such as grand pianos. For example, U.S. Pat. No. 5,387,074 entitled "Piano Lift and Dolly" and issued Feb. 7, 1995 to Brown discloses a piano lift and dolly with an upper H-frame that engages a piano and a lower H-frame that is supported on wheels. Four posts extend vertically upwardly from the lower H-frame and are received in downwardly extending tubes connected to the upper H-frame. A jack has its base mounted on a cross beam of the lower H-frame and its jack RAM mounted directly to a center point of the cross beam of the upper H-frame. Two beams of the upper H-frame engage the underside of the piano at different heights with respect to a floor on which the dolly is supported. As the jack is raised, the RAM raises the upper H-frame with respect to the lower one to lift a piano off of the floor. In this way, the piano is moved without the legs of the piano engaging the floor.

U.S. Pat. No. 2,904,308 entitled "Piano Lifting Apparatus and Turntable Support" issued Sep. 15, 1959 to Vergara is to like effect. It provides the hoist with a turntable support for the piano, such support being provided with horizontally and vertically adjustable support means adapted to engage the variable level underside portions of a grand piano while it is being turned, for example to facilitate finishing or refinishing the woodwork.

Still other devices have a support structure with transverse load-bearing arms to reach in and under a side of the furniture to raise it. For example, U.S. Pat. No. 5,358,217 entitled "Lifting Apparatus" and issued Oct. 25, 1994 to Dach discloses a lifting apparatus which includes a base with two spaced apart tubular members extending substantially vertically from the base. Two telescopic members are telescopically received in the tubular members. A transverse member is secured transversely between the telescopic members. A jack positioning seat is positioned with the base vertically aligned with the transverse member, such that a jack placed on the jack positioning seat engages the transverse member to telescopically raise telescopic members. A pair of parallel spaced support arms extend from the transverse member, each support arm has lifting points adapted for positioning under an object to be lifted. The base is adapted to maintain stability when a load is placed on the lifting points of the support arms. The telescopic members are locked in a selected position relative to the tubular members when the object being lifted is at the desired height.

There remains a need for a simple lifting apparatus for elevating furniture and other loads which does not suffer from the limitations of the prior art.

SUMMARY OF THE INVENTION

According to one embodiment of the present invention there is provided a lifting apparatus for elevating a load, such as furniture, above a surface. The apparatus comprises a support structure, a telescoping support and an extension actuator or jack. The support structure extends substantially in a plane transverse to the surface and comprises a bracket extending substantially transversely away from the surface along the plane. The telescoping support lies substantially within the plane and is adapted to engage the bracket in a sliding fit at a first end and to engage and support a load surface at a second end. The extension actuator or jack is mounted on the support structure for extending the telescoping support and any load supported thereon transversely away from the surface relative to the bracket. Loads to be elevated include, but are not limited to furniture and accessories typically found in office settings.

In another embodiment of the present invention, a lifting system is provided which comprises a plurality of lifting apparatuses described above. The lifting apparatuses are adapted to be positioned at different protruding ends of the load so as to completely support the load away from the surface.

In another embodiment of the present invention, there is provided a kit of parts for assembling a lifting apparatus for elevating a load above a surface. The kit of parts comprises a support structure comprising a bracket lying within a plane, a telescoping support adapted to engage the bracket in a sliding fit and to lie substantially within the plane, and an extension actuator for engaging the bracket and surface and for extending the telescoping support and any load supported thereon transversely away from the surface relative to the support structure.

BRIEF DESCRIPTION OF THE DRAWING

The embodiments of the present invention will now be described by reference to the following figure:

FIG. 1 is an elevation view of a furniture lifter according to one embodiment of the present invention.

DETAILED DESCRIPTION

References to "furniture" as described herein, include references to office furniture, accessories and other loads.

A wheel-mounted furniture lifter is disclosed that has a base having a plurality of radially extending beams, a planar support structure, directly over one of the beams of the base, including a telescoping ram driven by a removable hydraulic jack. The height of the telescoping ram may be locked using a key and the jack removed thereafter. The planar support structure of the lifter permits the lifter to be able to be positioned in tight quarters such as between a desk and a wall or up against a pedestal of the furniture to be lifted. The telescoping ram lies substantially within the plane of the support structure and is adapted to engage a piece of furniture from below and extend it vertically upward and away from the floor surface. Once the furniture is supported on a plurality of such furniture lifters, the vertically downward load imposed upon the lifters is such that the furniture and the lifters may be easily maneuvered as a single piece away from the wall to permit sufficient clearance to allow operations on the floor surface near the wall.

The present invention will now be described in detail for the purposes of illustration only, in conjunction with certain embodiments shown in the enclosed drawing.

Referring to FIG. 1, there is shown one embodiment of a furniture lifter according to the present invention. The lifter, shown generally at 100, comprises a base 110, an extension actuator or jack 120, a planar support structure 130 and a telescoping ram 140.

The base 110 is adapted to support the planar support structure 130 in a small footprint and has a plurality of radially extending beams in a planar configuration. In the illustrated embodiment, the base is cross-shaped with an elongate beam 111 and bisecting a transverse beam 112.

In one embodiment, the elongate beam 111 and the transverse beam 112 may each be 2 feet in length and be constructed of 2 inch wide steel stock. Preferably, the elongate beam 111 and the transverse beam 112 are composed of tubular steel, such as 1 inch square tubular steel, or other rigid material capable of bearing a load of a desk or other office furniture component and rigidly attached to one another, for example, by welding. For example, the elongate beam 111 and the transverse beam 112 may be wooden beams such as 2×4s and coupled together such as by nailing and/or bracing.

The radially extending beams 111, 112 of the base 110 permits the lifter 100 and in particular the telescoping ram 140 over the base's centre point to be easily positioned around and close to the furniture or load (not shown), with reduced likelihood of an extremity of the base 110 encountering an obstruction.

The base 110 may be mounted on wheels or casters 113 at its extremities for movement with or without load across the underlying floor surface (not shown).

Other radially extending small footprint configurations may also be suitable.

The jack 120 is a controllable and reversible extension actuator The jack 120 may be a portable hydraulic jack as shown in FIG. 1. The jack 120 is mounted at the intersection point of the plurality of radially extending beams 111, 112 of the base 110 below the planar support structure 130 and oriented such that the jack 120 may extend and retract in a direction substantially transverse to the plane of the base 110 and away from the floor surface (not shown). Preferably, the jack 120 is mounted, for example, in a shaped bracket (not shown) within the base 110, so as to facilitate its easy insertion and removal from the lifter 100, for example to be used in conjunction with other lifters 100 (not shown), while maintaining positional stability while mounted.

In one embodiment, the jack may be a 16 inch hydraulic automotive 2 ton jack. For convenience, the handle, which is typically removable, may be secured in place, such as by welding.

The planar support structure 130 lies substantially entirely within a plane extending substantially vertically over an axis defined by one of the radially extending beams 111, 112 of the base 110 and is secured thereto. In the configuration illustrated in FIG. 1, the planar support structure 130 defines a substantially triangular shape having a base that extends along the length of one of the beams of the base 110 and may be formed by such beam. The planar support structure 130 may comprise two diagonal beams 131, 132 that are joined at one end to a bracket 133 at the apex of the triangle and at the other end are joined to one of the beams of the base 110, for example, by welding. Alternatively, the planar support structure 130 may have an alternate configuration, for example a square or rectangular shape.

The restriction of the support structure 130 to a plane defined by one of the beams 111, 112 of the base 110, permits the lifter 100 to be positioned beside and/or under the furniture or load with little restraint, resulting in greater flexibility of positioning of the lifter 100, improved balance of the furniture on the lifter 100 and increased load-bearing capability.

The bracket 133 comprises a tubular element whose axis is oriented transversely away from a plane defined by the base 110 and lying in the plane defined by the planar support structure 111 and adapted to accept in a sliding fit, a tubular portion of the telescoping ram 140. The bracket 133 has a side bore 134 extending transversely through it, suitable for accepting a cotter pin 135 to lock the telescoping ram 140 at a desired extension position. Preferably, the cotter pin 135 is attached to the lifter 100, as by a chain 136 affixed to the planar support structure 130.

Preferably, as shown in FIG. 1, the bracket 133 is polygonal in shape to define a plurality of apexes so as to reduce the likelihood of the telescoping ram 140 twisting and lying outside the plane of the planar support structure 111.

The telescoping ram 140 is a planar, preferably T-shaped structure, comprising a tubular portion 141 that abuts and bisects a support portion 142. The tubular portion 141 is sized to slidingly fit within the bracket 133 and has a plurality of bores 143 extending transversely through it, suitable for accepting the cotter pin 135 to lock the telescoping ram 140 at a desired extension position beyond the apex of the triangle of the planar support structure, defined by the bracket 133. The bores 143 are oriented to align with the bores 134 in the bracket 133 such that the support portion 142 of the telescoping ram 140 lies substantially within the plane defined by the planar support structure 130.

The support portion 142 is fixed to the telescoping ram 140, for example, by welding, and extends transversely relative to a protruding end of the tubular portion 141. The upper surface of the support portion 142 may be of a suitable width and length such that it can support a load during operation. The load to be lifted is borne on the surface of the support portion 142 opposite to the protruding end of the tubular portion 141. Preferably, the support portion 142 and the tubular portion 141 of the telescoping ram 140 are composed of rectangular tubular steel. In an example embodiment, the support portion may be 8 inches long.

In operation, the tubular portion 141 of the telescoping ram 141 may be inserted within the bracket 133 of the planar support structure 130 such that the support portion 142 lies substantially within the plane defined by the planar support structure 130. The cotter pin 135 may be withdrawn from the bores 134, 143 so as to permit the telescoping ram 141 to collapse to its maximum extent, which may be defined by the end of the tubular portion 141 opposite the support portion 142 engaging the base 110 or else the support portion 142 engaging the bracket 133. Alternatively, especially if a horizontal surface of the furniture to be lifted is substantially higher than the height of the bracket 133, the cotter pin 135 may be inserted within the bore 134 and a suitable one of the bores 143 to partially extend the support portion 142 to a point proximate to, but below, the height of the overhanging portion, so as to minimize the amount of extension of the lifter by the jack 120.

Thereafter, the lifter 100 is moved into position proximate to an end of the furniture to be lifted, such that the support portion 142 lies below but in a position to engage a horizontal surface of the furniture, which may be a bottom surface of a carcase, or an overhanging or protruding portion or edge of the furniture.

Once in position, the jack 120 may be mounted within the lifter 100, if not already in position. If the cotter pin 135 is inserted into the bores 134, 143, the jack 120 may be activated and urged upward until it engages the tubular portion 141, at which point the cotter pin 135 is removed to permit the tubular portion 141 to be further urged vertically upward by the jack 120 until the support portion 142 engages and urges vertically upward the overhanging or protruding portion or the edge of the furniture until the furniture, at least at the lifted end, no longer touches the underlying surface. As such, the lifter 100, bears the weight of the load.

The cotter pin 135 may then be re-inserted into the bore 134 and an appropriate one of the bores 143 to lock the telescoping ram 140 in position below and supporting the furniture at its protruding or overhanging portion or edge.

If the furniture or load is not at this point fully supported by the lifter 100, the jack 120 may be removed and mounted in another lifter 100, which may be positioned proximate to another protruding or overhanging portion or edge of the furniture where it is not supported, the process repeated.

When the furniture is fully supported by one or more lifters 100, the lifter(s) 100 and the furniture supported thereon will be free to be easily moved on the casters 113 as a unit to a suitable position so as to provide a desired amount of access to the floor surface, even when they engage the walls of the room.

The planar nature of the support structure 130 and the telescoping ram 140 permit the lifter to be positioned close to a vertical support of the furniture and to be used where there is very little clearance between the furniture to be moved and an obstacle, such as a wall or some other furniture. Where the furniture abuts the obstacle, it is usually sufficient to drag or lift the furniture slightly so as to provide clearance to introduce the lifter 100 between the furniture and the obstacle and engage the jack 120 as described previously.

The use of cotter pins 135 permit the jack 120 to be made removable and thus shared between a plurality of lifters 100 and other extendable devices, which is beneficial, considering that the jack 120 may typically be a more expensive component of the lifter.

Once the use of the lifter 100 is completed, the lifter 100 may be disassembled into a small series of relatively flat-lying and compact components for storage or travel. This may be facilitated by, for example, creating stumps on the base 110 adapted to engage the elements of the planar support structure 130 in a sliding fit yet being capable of being knocked down.

In the foregoing description, for purposes of explanation and not limitation, specific details are set forth in order to provide a thorough understanding of the present invention. However, it will be apparent to those having ordinary skill in this art that the present invention may be practised in other embodiments that depart from these specific details.

In some instances, detailed descriptions of well-known devices, and methods are omitted so as not to obscure the description of the present disclosure with unnecessary detail. All statements herein reciting principles, aspects and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those having ordinary skill in this art that diagrams reproduced herein can represent conceptual views of illustrative components embodying the principles of the technology.

It will be apparent to those having ordinary skill in this art that various modifications and variations may be made to the embodiments disclosed herein, consistent with the present disclosure, without departing from the spirit and scope of the present disclosure.

For example, the bracket 133 may not have a side bore 134. Rather, the cotter pin 135 would be inserted in one of the bores 144 in the telescoping ram 140 and allowed to rest on top of the bracket 133. Also, embodiments may be envisaged in which the bracket 133 is surrounded by the tubular portion 141 of the telescoping ram 140, rather than surround it.

While preferred embodiments are disclosed, this is not intended to be limiting. Rather, the general principles set forth herein are considered to be merely illustrative of the scope of the present disclosure and it is to be further understood that numerous changes covering alternatives, modifications and equivalents may be made without straying from the scope of the present disclosure, as defined by the appended claims.

The term "couple" in any form is intended to mean either an direct or indirect connection through other devices and connections.

Moreover, all dimensions described herein are intended solely to be exemplary for purposes of illustrating certain embodiments and are not intended to limit the scope of the disclosure to any embodiments that may depart from such dimensions as may be specified.

Directional terms such as "upward", "downward", "left" and "right" are used to refer to directions in the drawings to which reference is made unless otherwise stated. Similarly, words such as "inward" and "outward" are used to refer to directions toward and away from, respectively, the geometric centre of a device, area and/or volume and/or designated parts thereof.

References in the singular form include the plural and vice versa, unless otherwise noted.

The terms "including" and "comprising" are used in an open-ended fashion, and thus should be interpreted to mean "including, but not limited to". The terms "example" and "exemplary" are used simply to identify instances for illustrative purposes and should not be interpreted as limiting the scope of the invention to the stated instances. In particular, the term "exemplary" should not be interpreted to denote or confer any laudatory, beneficial or other quality to the expression with which it is used, whether in terms of design, performance or otherwise.

Certain terms are used throughout to refer to particular components. As one skilled in the art will appreciate, manufacturers may refer to a component by different names. It is not intended to distinguish between components that differ in name but not in function.

Other embodiments consistent with the present application will become apparent from consideration of the specification and the practice of the disclosure disclosed herein.

What is claimed is:

1. A lifting apparatus for elevating a load above a surface, comprising:

a. a support structure extending substantially in a plane transverse to the surface and comprising a bracket extending substantially transversely away from the surface along the plane;

b. a telescoping support lying substantially within the plane and adapted to engage the bracket in a sliding fit at a first end and to engage and support a load surface at a second end;

c. an extension actuator mounted on the support structure for extending the telescoping support and any load supported thereon transversely away from the surface relative to the bracket wherein the bracket is substantially polygonal in cross-section and wherein the base comprises a plurality of radially extending beams.

2. A lifting apparatus according to claim 1, further comprising a base mounted to the support structure for maintaining the plane of the support structure substantially transversely away from the surface, the base extending parallel to the surface between the surface and the support structure.

3. A lifting apparatus according to claim 2, wherein the base is mounted on a plurality of wheels for engaging the surface.

4. A lifting apparatus according to claim 2, wherein the base protrudes beyond one side of the plane of the support structure.

5. A lifting apparatus according to claim 2, wherein the base protrudes a substantially equal distance on either side of the plane of the support structure.

6. A lifting apparatus according to claim 1, wherein one of the radially extending beams of the base lies within the plane.

7. A lifting apparatus according to claim 1, wherein the support structure is substantially triangular in shape.

8. A lifting apparatus according to claim 7, wherein the bracket lies substantially at an apex of the triangular shape of the support structure.

9. A lifting apparatus according to claim 1, wherein the bracket is substantially tubular.

10. A lifting apparatus according to claim 1, wherein the telescoping support has at least one transverse bore for accepting a transverse locking mechanism therewithin.

11. A lifting apparatus according to claim 10, wherein the transverse locking mechanism comprises a pin for insertion into one of the at least one transverse bores of the telescoping support.

12. A lifting apparatus according to claim 1, wherein the bracket has a transverse bore for accepting a transverse locking mechanism therewithin.

13. A lifting apparatus according to claim 1, wherein the telescoping support is substantially T-shaped, with a central member adapted to engage the bracket in a sliding fit and a transverse member abutting one end of the central member for supporting the load surface.

14. A lifting apparatus according to claim 1, wherein the telescoping support is removable from the bracket of the support structure.

15. A lifting apparatus according to claim 1, wherein the extension actuator is a jack.

16. A lifting apparatus according to claim 15, wherein the jack is hydraulically actuated.

17. A lifting apparatus according to claim 1, wherein the extension actuator is removable therefrom.

18. A lifting apparatus according to claim 1, wherein the support structure is adapted to securely accept the extension actuator.

19. A lifting system comprising a plurality of lifting apparatuses according to claim 1, adapted to be positioned at different protruding ends of the load so as to completely support the load away from the surface.

20. A lifting system according to claim 19, wherein each of the plurality of lifting apparatuses and the load supported thereon are capable of relative free movement as a unit across the surface.

21. A kit of parts for assembling a lifting apparatus for elevating a load above a surface, the kit of parts comprising:

a. a support structure comprising a bracket lying within a plane;

b. a telescoping support adapted to engage the bracket in a sliding fit and to lie substantially within the plane;

c. an extension actuator for engaging the bracket and surface and for extending the telescoping support and any load supported thereon transversely away from the surface relative to the support structure wherein the bracket is substantially polygonal in cross-section and wherein the base comprises a plurality of radially extending beams.

* * * * *